US006009940A

United States Patent [19]

Eck et al.

[11] Patent Number: 6,009,940

[45] Date of Patent: Jan. 4, 2000

[54] PRODUCTION IN FRIGID ENVIRONMENTS

[75] Inventors: Daniel J. Eck, Anchorage, Ak.; John C. Patterson, Garland, Tex.

[73] Assignee: Atlantic Richfield Company, Los Angeles, Calif.

[21] Appl. No.: 09/045,293

[22] Filed: Mar. 20, 1998

[51] Int. Cl.[7] ..... E21B 36/04

[52] U.S. Cl. ..... 166/60; 166/302; 166/901; 392/305

[58] Field of Search ..... 166/60, 302, 901; 392/305, 301, 468, 472; 219/549; 338/214

[56] References Cited

U.S. PATENT DOCUMENTS 3,485,300 12/1969 Engle ..... 166/265

4,616,705 10/1986 Stegemeier et al. ..... 166/250

*Primary Examiner*—William Neuder
*Assistant Examiner*—Zakiya N. Walker
*Attorney, Agent, or Firm*—Drude Faulconer

[57] ABSTRACT

A method and apparatus for producing (e.g. heavy oil) through a wellbore which passes through a permafrost layer. To maintain an acceptable flow temperature inside the production tubing, a heating element (e.g. electrical power cable having its leads short-circuited) is lowered down the production tubing to generate heat inside the tubing when electricity is supplied thereto. A sensor is provided to sense the temperature inside the tubing and activate a source to supply electricity to the cable whenever the temperature inside the production tubing drops below the desired temperature.

13 Claims, 2 Drawing Sheets

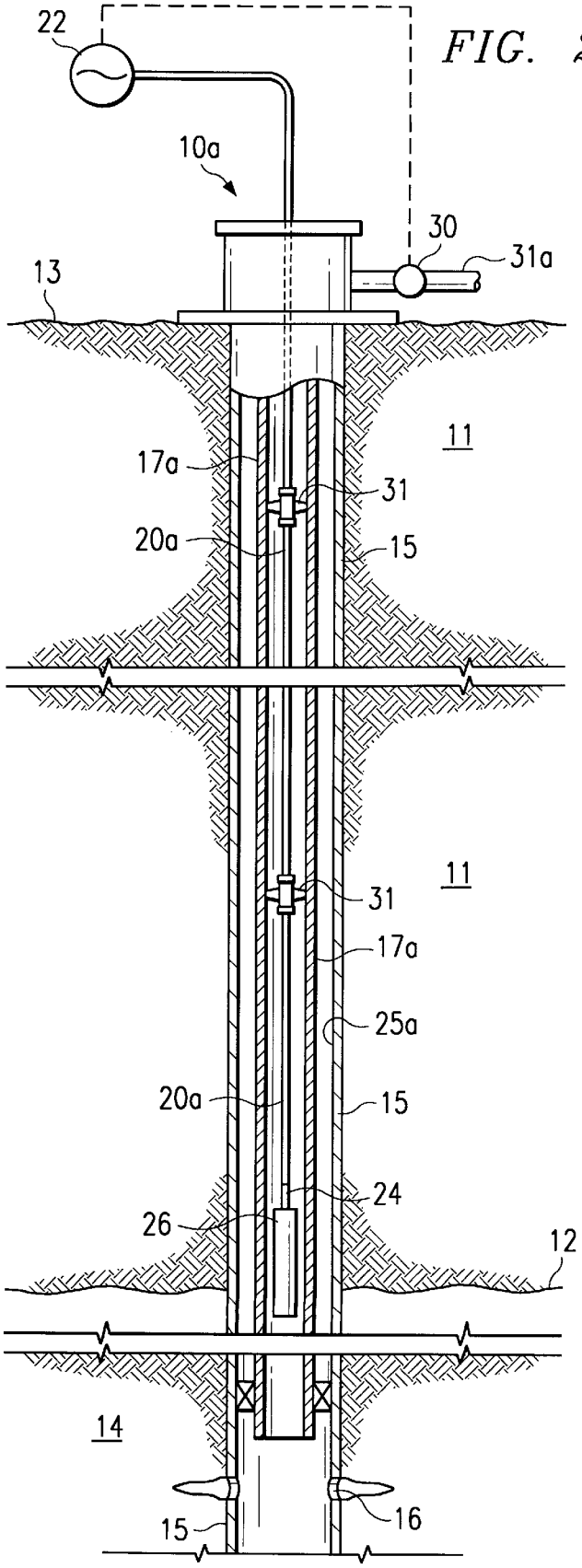
FIG. 2
FIG. 3
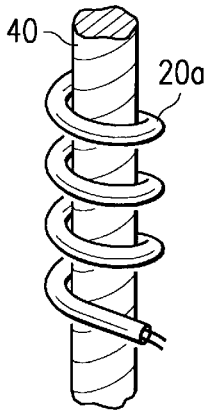

PRODUCTION IN FRIGID ENVIRONMENTS

TECHNICAL FIELD

The present invention relates to a method and apparatus used in producing fluids from a subterranean formation located in a frigid environment and in one aspect relates to a method and apparatus used in producing fluids wherein a heating element is positioned inside the production tubing of a well which extends through a permafrost layer of the earth to maintain fluids (e.g. oil) being produced through the tubing at a temperature at which they can readily flow.

BACKGROUND

It is well known that large reservoirs of petroleum (e.g. heavy oil) are found in certain frigid areas of the world; e.g. the North Slope area of Alaska. As will be readily recognized, the extreme cold temperatures which normally exist in these areas significantly add to the problems involved in the economical production of these reservoirs. For example, one of the major costs involved in producing shallow, heavy oil reservoirs in frigid areas is that incurred in maintaining a suitable temperature within the production tubing so that the production fluids can readily flow or be pumped therethrough to the surface. This is especially vital for that portion of the production tubing which passes through the "permafrost" layer (i.e. permanently frozen layer) which is normally present in such frigid areas. If the temperature within the tubing drops too much, especially during low flow or no flow (i.e.shut-in) conditions, the well fluids cool off and can become too viscous to readily flow or to be pumped through the tubing. In some cases, the fluids may actually freeze solid within the tubing thereby creating a myriad of problems when the well is returned to full flow production.

Some of the more common approaches presently used in dealing with this problem include: (a) insulating the production tubing and/or the wellbore; (b) displacing the well fluids from the production tubing back into the wellbore and/or production formation with a non-freezing or anti-freeze fluid (e.g. methanol, diesel, or natural gas) during no-flow conditions; or (c) strapping an electrical, heat trace to the outside of the production tubing to heat the tubing and thereby maintain the temperature within the production tubing at an acceptable flow temperature. Unfortunately, while each of these techniques may be applicable to particular situations, each may have serious drawbacks in others.

For example, insulating the production tubing and/or the wellbore simply does not prevent freezing of the well fluids in the tubing but merely slows down the process. As to displacing the well fluids back out of the production tubing while production is shut-in, this process is normally expensive and labor intensive in that it must be carried out manually and can not be easily automated to "kick-in" only when needed. And finally, strapping the heat trace to the outside of the production tubing is grossly inefficient due to the amount of heat which is lost directly to the surrounding annulus in the wellbore and is unavailable for heating the inside of the production tubing. That is, a large portion of the heat generated by an externally-mounted heat trace is immediately lost in the well annulus and is never conveyed to the inside of the production tubing where it needed. Accordingly, it can be seen that a need continues to exist for automatically maintaining the temperature inside the production tubing of a well which extends through a permafrost layer at a desired temperature which allows ready flow of produced fluids therethrough, especially during low or no flow production rates.

SUMMARY OF THE INVENTION

The present invention provides a method and apparatus for producing fluids (e.g. heavy oil) from a subterranean formation which lies under a permafrost layer. To maintain an acceptable temperature (e.g. above about 50° F.) inside the production tubing, a heating element is lowered down the production tubing and extends through at least the permafrost layer. Preferably, the heating element is a heat trace which is comprised of a commercially-available, electrical power cable of the type commonly used to supply electrical power to downhole submersible, electrical well pumps. The lower ends of the leads within the cable are connected together to "short-circuit" the cable thereby converting the cable into an elongated, heating element.

A weight may be connected to the lower end of the cable to assist in lowering the cable down into the production tubing. Further, spacers may be positioned along the length of the cable to position the cable with relation to the wall of the production tubing, if necessary. Still further, the heater cable can be wrapped around a core support member, e.g. wire rope of the like, which, in turn, is lowered into the wellbore to provide support for the heater cable.

Electricity is supplied to the cable to generate heat along the length of the cable which, in turn, heats the inside of the production tubing thereby maintaining the temperature in the tubing at or above the desired temperature. A sensor is provided which senses the temperature inside the production tubing and which is adapted to activate a source of electricity to supply electricity to the cable whenever the temperature inside the production tubing drops below the desired temperature. This is important in insuring that the produced fluids do not freeze, form hydrates, and that the oil being produced through the tubing will not be cooled to a temperature at which it becomes too viscous to readily flow through the production tubing, even at low flow or no flow production rates.

While the internally-positioned heat trace of the present invention will generate substantially the same amount of heat as that generated by a functionally-equal, prior-art external-positioned heat trace, the internally-positioned heat trace provides a significantly greater amount of heat which is available inside the production tubing for maintaining the temperature inside the tubing at the desired temperature since little, if any, of the generated heat is lost into well annulus. Accordingly, the heating efficiency of basically the same heat trace has been estimated as increasing from 20% to about 95% by positioning basically the same heat trace internally instead of externally on the production tubing. Power savings and capital savings can be realized over an externally-mounted cable while maintaining the same internal fluid temperature as a result of this increased efficiency.

BRIEF DESCRIPTION OF THE DRAWINGS

The actual construction, operation, and apparent advantages of the present invention will be better understood by referring to the drawings which are not necessarily to scale and in which like numerals identify like parts and in which:

FIG. 2 is an elevational view, partly in section, of a wellbore extending through a permafrost layer of the earth which has been completed in accordance with the present invention wherein a heat trace element is positioned within the production tubing; and FIG. 3 is an enlarged, perspective view, partly broken away, of a further embodiment of the heat trace element of FIG. 2.

BEST KNOWN MODE FOR CARRYING OUT THE INVENTION

Figure 1:
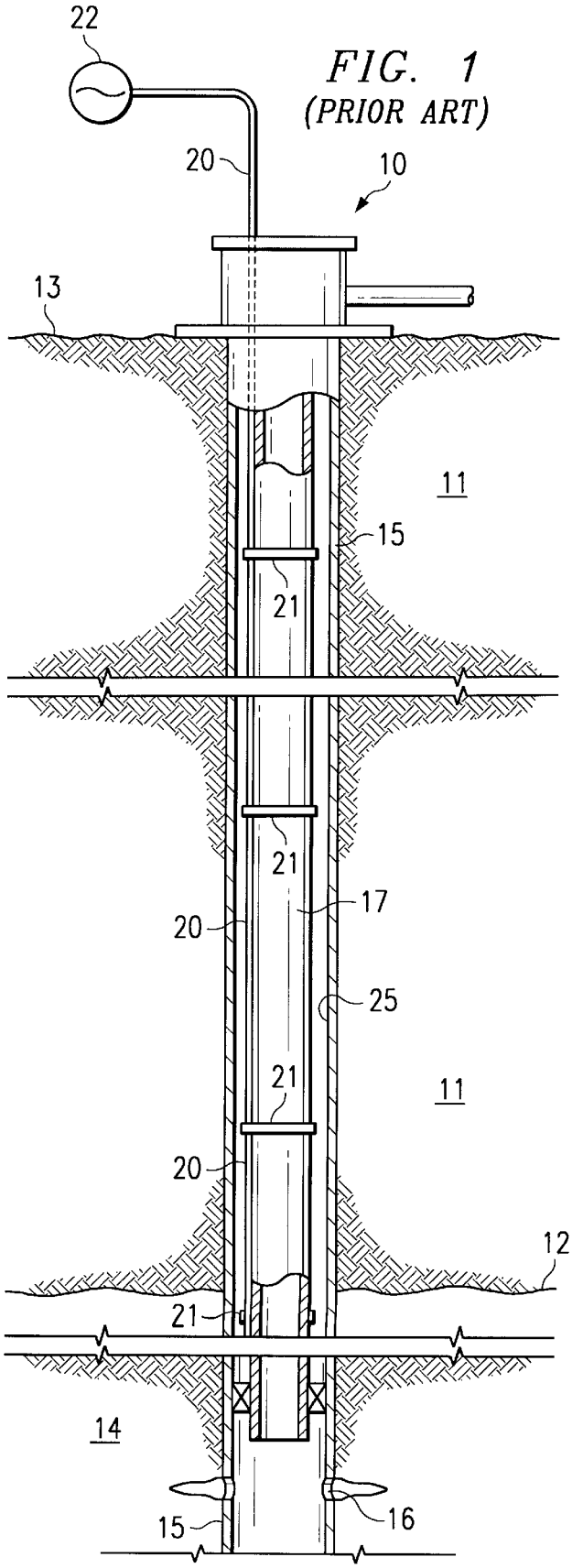
FIG. 1 (PRIOR ART)
FIG. 1 is an elevational view, partly in section, of a wellbore extending through a permafrost layer of the earth been completed in accordance with the prior art wherein a heat trace element is strapped to the outside of the production tubing.

Referring more particularly to the drawings, FIG. 1 illustrates a well 10 which has completed through a permafrost layer 11 of the earth in accordance with known prior art practices. As will be understood, a "permafrost" layer exists in many frigid areas of the world (i.e. an area with extremely cold temperatures such as the North Slope area of Alaska) and is that layer of the earth which extends to a substantial depth 12 (e.g. 1500–2500 feet) below the surface 13. Except for the upper few feet at the surface (e.g. about 6 feet), the permafrost layer 11 remains frozen throughout the year and undergoes little, if any thawing.

In accordance with well known procedures, well 10 is drilled through permafrost layer 11 and into production formation 14 and is cased with casing 15 which, in turn, has perforations 16 therein adjacent formation 14. A string of production tubing 17 extends through permafrost layer 11 and into production formation whereby fluids (e.g. oil) can flow through the perforations 16 and up to the surface through tubing 17. As will be understood, the fluids may flow under bottom-hole pressure or more likely, as will be fully understood in the art, will be pumped upward through tubing 17 by a bottom-hole pump or the like, not shown for the sake of clarity.

Typically, the temperatures within permafrost layer 11 can be as low as 32° F. which, in turn, can lower the temperature within a typical string of production tubing 17 to as low as 32° F. However, the top of the tubing string and any exposed length thereof ( e.g. about 10 feet or so above the surface in many arctic wells) can see temperatures of −30° F. or lower. When oil, especially heavy crude, encounters such low temperatures, its viscosity substantially increases, thereby "thickening" the oil to a point that it becomes difficult, if possible at all, to produce it to the surface. In addition to the viscous effects on the crude, the lower temperatures, although above freezing, are in the hydrate-forming region. By maintaining the temperature above the hydrate temperature, production can be maintained from the well. Also, water produced with the oil may freeze and form an ice plug in the production tubing 17. As illustrated in the prior art completion of FIG. 1, it is common to secure a heat trace 20 to the outside of production tubing 17 by means of straps 21 or the like as tubing 17 is being lowered into well 10.

Heat trace 20 is actually an elongated, electrical heating element which runs at least along that portion of tubing 17 which lies adjacent permafrost layer 11 when production tubing is in an operable position within well 10. Heat trace 20 is typically of the self-regulating type and preferably is comprised of electrical power cable of the type which is commercially-available for use in a well to supply electric power to a downhole submersible, electrical pump or the like and are the type which have been previously used widely in the industry for heat tracing surface lines in cold areas. Further, The lower ends of the leads of the cable are connected together to "short-circuit" the cable, thereby converting the cable into it an elongated, resistive heating element whereby heat will generate from the cable when electricity is supplied thereto from a source of electricity 22.

A typical, short-circuited power cable of the type described above is capable of generating heat at a temperature of about 90° to about 150° F. under a predetermined load (e.g. 20 to 30 kilowatts per foot of tubing). While some of this generated heat radiates into and through the wall of tubing 17 to heat the fluid flowing through the tubing, a large portion of this heat is lost into the annulus 25 of well 10. Since, typically it is preferred to keep the temperature of the heavy oil flowing through the tubing 17 at a temperature above 50° F. (e.g. between about 50° F. and about 70° F.) to insure ready flow therethrough, it can be seen that the load on cable 20 has to be substantial since the heating efficiency from the externally-mounted cable 20 is extremely low.

Referring now to FIG. 2, a well 10*a* completed in accordance with the present invention is illustrated. Well 10*a* is similar to well 10 above in that it is drilled and cased in the same manner and a string of production tubing 17*a* is positioned therein. However, in well 10*a*, electrical heating trace 20*a* is positioned internally of tubing 17*a*. Heat trace 20*a* may be comprised of the same electrical power cable as described above which shorted-circuited at its lower end by connecting its leads (not shown) at terminal 24. Preferably, heat trace 20*a* is lowered into tubing 17*a* from the surface after tubing 17*a* has been positioned within well 10*a* and will substantially extend through at least that portion of the tubing which passes through permafrost layer 11.

To aid in lowering heat trace 20a within tubing 17*a*, a weight 26 or the like may be attached to the lower end (e.g. below terminal 24) of heat trace 20*a*. Further, if necessary, one or more spacers 31 can be spaced along the length of heat trace 20*a* to position the cable in relation to the wall of the tubing 17*a*—i.e. to centralize cable 20*a* within tubing 17*a* (as shown) or to hold it to one side of the tubing or to position it in some other configuration within the tubing; depending on whether a submersible pump or a rod-actuated pump is to be used to lift the oil through the tubing 17*a*.

FIG. 3 discloses a further embodiment of a heat trace element wherein addition strength may be needed for supporting the trace element within tubing 17*a*. As illustrated, heat trace 20*a* is wrapped around a core element 40 (e.g. wire rope, steel cable, or the like) and is lowered therewith into tubing 17*a*. A drum (not shown) is used to spool the cable and/or the heat trace into and out of tubing 17*a* similarly as is done with downhole electrical, submersible pump cable as the like, as will be understood in the art.

It can be seen that while internal heat trace 20*a* will generate substantially the same heat as does external trace 20 in FIG. 1, the amount of generated heat available inside the tubing 17*a* for maintaining the inside temperature inside the tubing at the desired temperature is significantly greater since little, if any, of the heat is lost into well annulus 25*a*. More specifically, it has been estimated that the heating efficiency of basically the same heat trace when used to maintain the inside temperature of a production tubing can be increased from about 20% to about 95% by positioning the heat trace inside the production tubing instead of mounting it externally. Further, by positioning the heat trace inside the tubing, it can be removed and repaired or replaced without having to pull the tubing string 17*a*.

To automatically maintain the temperature within tubing 17*a*, especially during low flow or no flow conditions, a temperature-sensor 30, e.g. thermostat or the like, can be positioned within tubing outlet pipe 31*a* or at some other position along production tubing 17*a*. A variable tap transformer (not shown) can also be used to change the applied amperage thus changing the heat generated in the heat trace cable. In some instances, an on-off control with a viable tapped transformer can offer cost reduction over the use of a variable controller circuit. Again referring to the drawings, sensor 30 senses when the inside temperature drops below a desire value, e.g. 50°, and is adapted to activate source 22 to supply electricity to heat trace 20*a* until the inside temperature of the tubing 17*a* is back within its desired range. By automatically controlling the temperature within tubing 17*a*, long production/shut-in cycles can be programmed without requiring personnel to be present at the well during such cycles. The electrical penetration of the well head 13 is accomplished using known penetrator technology. However, the penetrator will need to be modified to support the load of the heat trace cable in the tubing and would provide for the upper termination of the core element 40 (FIG. 3), if used.

What is claim is:

1. In a well having a wellbore which passes through a permafrost layer, apparatus for producing fluids from a subterranean formation which lies below said permafrost layer, said apparatus comprising:

a string of production tubing positioned within said wellbore and extending from a surface of the earth through said permafrost layer and into said subterranean formation and through which said fluids are produced to said surface; and a heating element positioned inside said string of production tubing, said heating element adapted to maintain a temperature within said production tubing at a desired temperature during at least low or no flow of said fluids through said production tubing; said heating element being comprised of a heat trace which is positioned within said tubing and which extends from the surface through at least said permafrost layer to maintain the temperature of said fluids within said production tubing at temperatures which permit said fluids to flow.

2. The apparatus of claim 1 wherein said heat trace is comprised of a length of electrical power cable having leads extending therethrough, the lower ends of which are connected together to thereby short-circuit said cable.

3. The apparatus of claim 2 wherein said heat trace is wrapped around a core element which is positioned within said tubing and which extends from the surface of the earth through at least said permafrost layer.

4. The apparatus of claim 3 wherein said core element is comprised of wire rope.

5. The apparatus of claim 2 including:

a weight connected to said electrical power cable.

6. The apparatus of claim 2 including:

a sensor for sensing the temperature inside said production tubing and adapted for activating a source of electricity to supply electricity to said cable when the inside temperature drops below a desired level.

7. The apparatus of claim 2 including:

at least one spacer affixed to and positioned along the length of said electrical power cable; said spacer engaging a wall of said production tubing for positioning said cable with respect to the wall of said production tubing.

8. A method of producing fluids from a subterranean formation through a wellbore which passes through a permafrost layer, said method comprising;

lowering a string of production tubing in said wellbore which extends from the surface of the earth through said permafrost layer and into said subterranean formation and through which said fluids are produced to said surface;

lowering an electrical heating element inside said production tubing; said heating element being comprised of a heat trace which is positioned within said tubing and which extends from the surface through at least said permafrost layer to maintain the temperature of said fluids within said production tubing above freezing temperatures of said fluids; and supplying electricity to said heating element to generate heat for heating the inside of said production tubing.

9. The method of claim 8 wherein said heat trace is comprised of a length of electrical power cable having leads extending therethrough, the lower ends of which are connected together to thereby short-circuit said cable.

10. The method of claim 9 including:

attaching a weight onto said electrical power cable before lowering said cable into said production cable.

11. The method of claim 9 including:

a sensor for sensing the temperature inside said production tubing and adapted to activate a source of electricity to supply electricity to said cable when the inside temperature drops below a desired level.

12. The method of claim 9 including:

wrapping said heat trace around a core element before lowering said heat trace and said core element into said production tubing.

13. The method of claim 12 wherein said core element is comprised of wire rope.

* * * * *